US009825361B2

(12) United States Patent
Pachler et al.

(10) Patent No.: US 9,825,361 B2
(45) Date of Patent: Nov. 21, 2017

(54) ANTENNA WITH MULTIFREQUENCY CAPABILITY FOR MINIATURIZED APPLICATIONS

(71) Applicant: Infineon Technologies AG, Neubiberg (DE)

(72) Inventors: Walther Pachler, Graz (AT); Gerald Holweg, Graz (AT)

(73) Assignee: INFINEON TECHNOLOGIES AG, Neubiberg (DE)

( * ) Notice: Subject to any disclaimer, the term of this patent is extended or adjusted under 35 U.S.C. 154(b) by 104 days.

(21) Appl. No.: 14/504,450

(22) Filed: Oct. 2, 2014

(65) Prior Publication Data

US 2015/0097741 A1 Apr. 9, 2015

(30) Foreign Application Priority Data

Oct. 4, 2013 (DE) ..... 10 2013 111 027

(51) Int. Cl.

| | |
|---|---|
| ***H01Q 7/00*** | (2006.01) |
| ***H01Q 5/00*** | (2015.01) |
| ***H01Q 1/22*** | (2006.01) |
| ***H01Q 21/30*** | (2006.01) |

(52) U.S. Cl.

CPC ..... *H01Q 5/0024* (2013.01); *H01Q 1/2208* (2013.01); *H01Q 7/00* (2013.01); *H01Q 21/30* (2013.01)

(58) Field of Classification Search

CPC ..... H01Q 7/00; H01Q 5/0024; H01Q 1/2208
USPC ..... 343/742, 748, 855, 866
See application file for complete search history.

(56) References Cited

U.S. PATENT DOCUMENTS

| | | | | |
|---|---|---|---|---|
| 8,508,429 | B2 | 8/2013 | Nishioka et al. | |
| 2005/0001779 | A1* | 1/2005 | Copeland | G06K 7/10336 343/867 |
| 2005/0001785 | A1* | 1/2005 | Ferguson | G06K 19/07745 343/895 |
| 2005/0258966 | A1* | 11/2005 | Quan | G06K 7/10128 340/572.7 |

(Continued)

FOREIGN PATENT DOCUMENTS

| | | | |
|---|---|---|---|
| DE | 10056148 | A1 | 5/2002 |
| DE | 102008022537 | A1 | 11/2008 |

(Continued)

OTHER PUBLICATIONS

Hwang et al., "Design and Analysis of High-Performance Smart Card with HF/UHF Dual-Band RFID Tag and Memory Functions", International Journal of Distributed Sensor Networks, vol. 2013, 9 pages.

(Continued)

*Primary Examiner* — Dieu H Duong
(74) *Attorney, Agent, or Firm* — Viering, Jentschura & Partner mbB

(57) ABSTRACT

A circuit arrangement includes a first antenna configured to couple to an electromagnetic field from a first frequency band and a second antenna configured to couple to an electromagnetic field from a second frequency band, the second frequency band being different than the first frequency band. The first antenna is connected in series with the second antenna as an electrical supply line therefor.

15 Claims, 6 Drawing Sheets

(56) References Cited

U.S. PATENT DOCUMENTS

| | | | | |
|---|---|---|---|---|
| 2006/0038731 | A1* | 2/2006 | Turner | H01Q 1/36 343/742 |
| 2006/0043198 | A1 | 3/2006 | Forster | |
| 2007/0158438 | A1* | 7/2007 | Fukuda | G06K 19/0723 235/492 |
| 2008/0055047 | A1 | 3/2008 | Osada et al. | |
| 2008/0278391 | A1 | 11/2008 | Mayer | |
| 2009/0179812 | A1 | 7/2009 | Nakamura et al. | |
| 2010/0109968 | A1* | 5/2010 | Suzuki | H01Q 1/2216 343/876 |
| 2010/0230501 | A1 | 9/2010 | Fukushima et al. | |
| 2011/0068987 | A1* | 3/2011 | Carr | H01Q 1/2225 343/741 |
| 2011/0111792 | A1* | 5/2011 | Griffiths | H01Q 1/22 455/553.1 |
| 2013/0050047 | A1* | 2/2013 | Carr | H01Q 1/248 343/853 |

FOREIGN PATENT DOCUMENTS

| | | | |
|---|---|---|---|
| FR | 2901041 | A1 | 11/2007 |
| WO | 02/39379 | A1 | 5/2002 |
| WO | 2007/135269 | A1 | 11/2007 |

OTHER PUBLICATIONS

Reinisch et al, "A Multifrequency Passive Sensing Tag With On-Chip Temperature Sensor and Off-Chip Sensor Interface Using EPC HF and UHF RFID Technology", IEEE Journal of Solid-State Circuits, vol. 46, No. 12, 2011, pp. 3075-3088.

Missoni et al., "A Triple-Band Passive RFID Tag", IEEE International Solid-State Circuits Conference, Session 15, 2008, pp. 288-289 and p. 614, 3 pages.

Missoni et al., "A Triple-Band Passive RFID Tag", IEEE International Solid-State Circuits Conference, 2008, 30 pages.

Leong et al., "Dual-frequency antenna design for RFID application", 21st International Technical Conference on Circuits/Systems, Computers and Communications, 2006, Thailand, 4 pages.

Leong et al., "Miniaturization of dual frequency RFID antenna with high frequency ratio", Antennas and Propagation Society International Symposium, IEEE, 2007, pp. 5475-5478.

Tan et al., "Compact dual band tag antenna design for radio frequency identification (RFID) application", Progress in Electromagnetics Research C, 2012, vol. 31, pp. 29-40.

Deleruyelle et al., "Dual band mono-chip HF-UHF tag antenna", Antennas and Propagation Society International Symposium(APSURSI), IEEE, 2010, 4 pages.

Deleruyelle et al., "Multi-standard mono-chip HF-UHF RFID tag antenna", Microwave Conference (EuMC), 2010, pp. 1094-1097.

Mayer et al., "A Dual-Band HF / UHF Antenna for RFID Tags", Vehicular Technology Conference, IEEE 68th, 2008, pp. 1-5.

Unknown, "ULTRA Small Package UHF RFID Tag Design Guideline", 2013, Rev. 2.3, Hitachi Chemical Co., Ltd. retrieved from < http://www.hitachi-chem.co.jp.english/products/ppcm/014.html> on Jan. 25, 2017.

* cited by examiner

ANTENNA WITH MULTIFREQUENCY CAPABILITY FOR MINIATURIZED APPLICATIONS

CROSS-REFERENCE TO RELATED APPLICATION

This application claims priority to German Patent Application Serial No. 10 2013 111 027.4, which was filed Oct. 4, 2013, and is incorporated herein by reference in its entirety.

TECHNICAL FIELD

Various embodiments relate generally to an antenna with multifrequency capability that can be used for miniaturized applications, for example.

BACKGROUND

To date, there have been multiple approaches and implementations of antennas that can receive both HF (high frequency) radiation and UHF (ultra high frequency) signals. However, the magnitude thereof is usually stipulated by the conditioning to RFID (radio-frequency identification—identification by means of electromagnetic waves) standards for RFID tags (RFID transponders). In addition, an antenna that can receive both HF and UHF waves is always provided as a combination of a dipole antenna for the UHF waves and a coil antenna for the HF waves and is often also referred to as a "comprehensive antenna".

FIG. 1 shows a typical antenna structure 100 that can couple to both HF and UHF fields. The antenna structure has a coil antenna 102 for receiving HF signals. In addition, the antenna structure 100 has a dipole antenna 106 for receiving UHF signals. An input connection 104 can be used to electrically couple the coil antenna 102 to an RFID chip 108 and to the dipole antenna 106. In the case of the antenna structure shown in FIG. 1, the dimensions thereof are also denoted. The length 114 may typically be 84 mm, and the width 112 may typically be 54 mm. These dimensions illustrate that such an antenna design, as has typically been used to date for RFID systems, does not allow miniaturization.

SUMMARY

A circuit arrangement includes a first antenna configured to couple to an electromagnetic field from a first frequency band and a second antenna configured to couple to an electromagnetic field from a second frequency band, the second frequency band being different than the first frequency band. The first antenna is connected in series with the second antenna as an electrical supply line therefor.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

In the detailed description that follows, reference is made to the appended drawings, which form part of this description and which show specific embodiments in which the invention can be executed for the purpose of illustration. In this respect, directional terminology such as "at the top", "at the bottom", "at the front", "at the rear", "front", "rear", etc., is used with reference to the orientation of the figure(s) described. Since components of embodiments can be positioned in a number of different orientations, the directional terminology is used for the purpose of illustration and is in no way restrictive. It goes without saying that other embodiments can be used and structural or logical changes made without departing from the scope of protection of the present invention. It goes without saying that the features of the various embodiments described herein can be combined with one another unless specifically stated otherwise. The following detailed description should therefore not be regarded as restrictive, and the scope of protection of the present invention is defined by the attached claims.

Within the context of this description, the terms "connected" and "coupled" are used to describe both direct and indirect connection, and also direct and indirect coupling. In the figures, identical or similar elements are provided with identical reference symbols, insofar as this is expedient.

Figure 1:
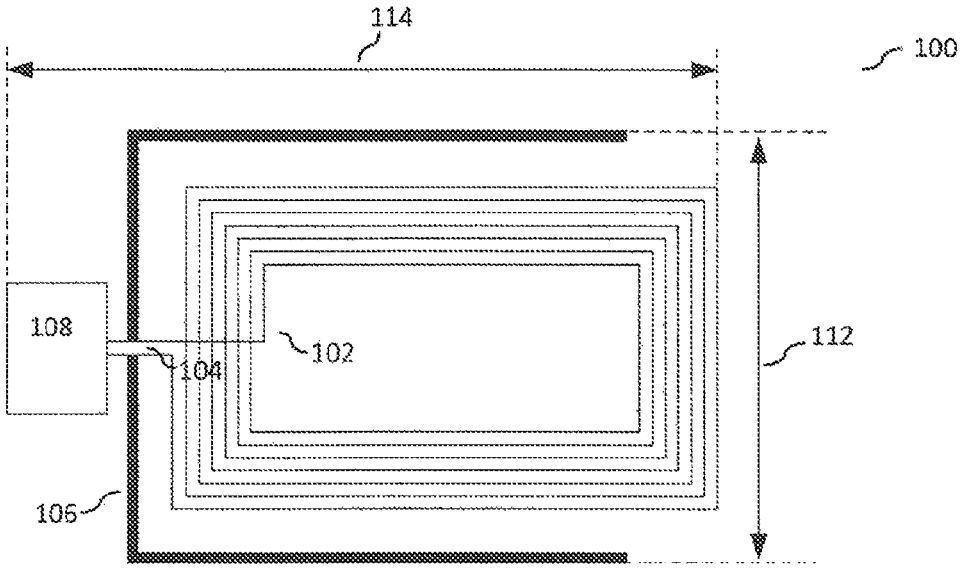
FIG. 1 shows a standard antenna that can receive via both the UHF and the HF frequency band.
Figure 2:
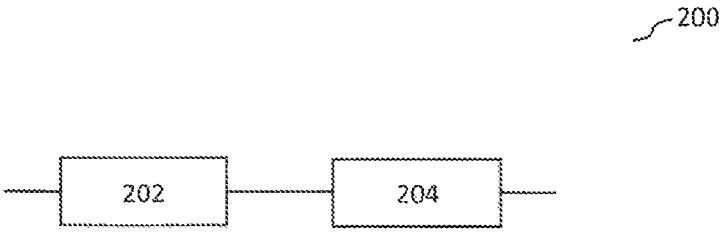
PRIOR ART FIG.2
FIG. 2 shows a circuit arrangement according to various embodiments.

FIG. 2 shows an embodiment of the circuit arrangement 200. The circuit arrangement 200 according to various embodiments has a first antenna 202, which is set up to couple to an electromagnetic field from a first frequency band. In addition, the circuit arrangement 200 according to various embodiments has a second antenna 204, which is set up to couple to an electromagnetic field from a second frequency band, the second frequency band being different from the first frequency band. The first antenna 202 is connected in series with the second antenna 204 as an electrical supply line therefor.

The circuit arrangement shown in FIG. 2 is essentially based on a combination of two different antennas, that is to say of two different coils or loop antennas, for example. In this case, the first antenna acts as a high-frequency antenna and additionally serves as an electrical supply line for the low-frequency antenna. The two antennas are connected in series and thus form the circuit arrangement according to various embodiments. Low-frequency signals are received by inductive coupling between the associated electromagnetic field and the second antenna 210. The first antenna 204 is not tuned to low-frequency signals, i.e. its resonant circuit has a different—that is to say that it has a large shift in comparison with the frequency of the low-frequency signals—resonant frequency. By way of example, the inductance of the first antenna 204 may be in a range from approximately 5 nH to approximately 50 nH, for example approximately 30 nH, and hence turn out to be rather low. As a result, the first antenna 204 has hardly any effect in an associated circuit when low-frequency signals are received by the second antenna 210. When high-frequency signals are received by the first antenna 204, the second antenna 210 again has almost no effect (apart from as an electrical supply line for the first antenna 204). The second antenna 210 may have a high capacitance in comparison with the first antenna 204, said high capacitance being able to be in the range from approximately 10 pF to approximately 100 pF, for example approximately 19 pF. On account of the high capacitance of the second antenna, high-frequency signals are almost shortened thereby, as a result of which the second antenna 210 has no disturbing influence on the associated circuit when high-frequency signals are received. In other words, the high-frequency signals on the first antenna 204 are detected by appropriate excitation of the associated resonant circuit.

The reception and transmission ranges of the first antenna 204 may, as already mentioned, be different than those of the second antenna 210. While the first antenna 204 may be tuned to a main frequency or a frequency range from the UHF band, for example, the second antenna 210 may be tuned to a main frequency or a frequency range from the HF band. In this connection, main frequency means the theoretical or measured resonant frequency of the resonant circuit associated with the antenna. The antennas can be tuned to an associated reception and transmission frequency by means of capacitances. The capacitances used may be parasitic capacitances of the respective coils or of other electronic components. If this does not result in sufficiently large capacitances, it is possible to use separate capacitances. This aspect is explained in more detail with reference to the figures that are yet to follow.

The circuit arrangement 200 according to various embodiments can be distinguished by a compact design and they can therefore be used as an on chip antenna, for example, i.e. as an antenna that is coupled to a chip of a chip card and, together with said chip, is arranged in a chip package that may in turn be laminated in a chip card. In this way, the associated chip, for example an RFID chip, can be operated at various frequencies that may be prescribed by the two antennas.

Figure 3A:
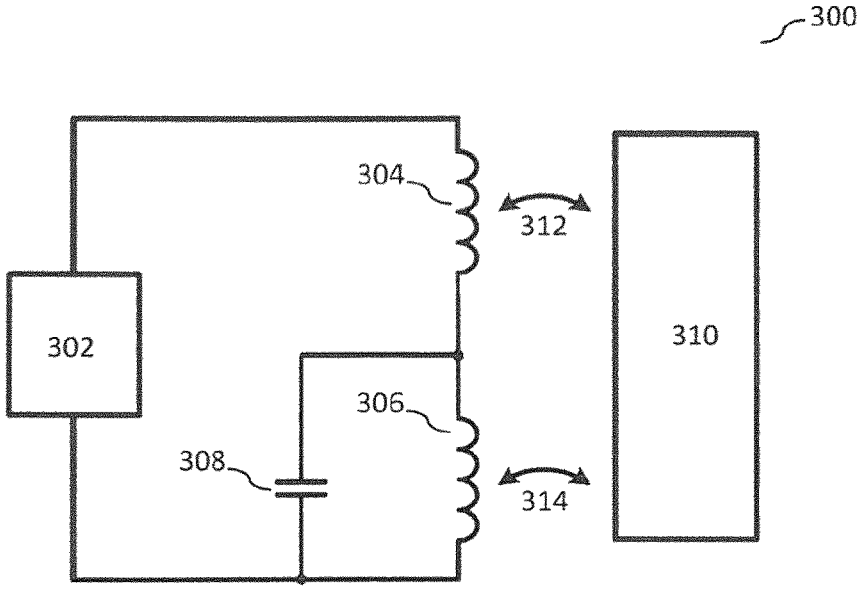
FIGS. 3A and 3B show further circuit arrangements according to various embodiments.

A further configuration of the circuit arrangement 300 according to various embodiments is shown in FIG. 3A. The circuit arrangement has a first coil 304 and a second coil 306 that embody the first antenna and the second antenna, respectively. In addition, the circuit arrangement 300 according to various embodiments has an integrated circuit 302 that is electrically coupled to the series circuit including the first coil 304 and the second coil 306. Additionally, the circuit arrangement 300 according to various embodiments has a capacitance 308 that is connected in parallel with the second coil 306. The rectangle 310 is a substitution for an apparatus to which the first coil 304 and the second coil 306 can couple magnetically. Thus, the rectangle 310 may represent a reading apparatus that transmits signals (i.e. transmits an electromagnetic field) that can be detected by means of the first coil 304 or the second coil 306. In this case, the first arrow 312 indicates inductive coupling between the first coil 304 and the querying apparatus, that is to say a reading unit, for example. The second arrow 314 indicates inductive coupling between the second coil 306 and the querying apparatus. On the basis of the different frequencies to which the two coils respond and on the basis of the architecture of the exemplary circuit arrangement 300 according to various embodiments, it can be assumed that simultaneous inductive coupling by means of the first coil 304 and by means of the second coil 306 does not occur during operation of the circuit arrangement 302.

The rectangle 310 may alternatively represent a booster antenna in a chip card. A booster antenna can be regarded as an intermediate antenna between the miniaturized antennas of a chip package arranged on a chip card module and a reading unit. A booster antenna can be used to increase the communication range of the circuit arrangement 300 according to various embodiments that may be arranged in a chip package of a chip card module in a chip card. The turns of the booster antenna may run close to the chip package and hence close to the first coil 304 and the second coil 306 in order to obtain a sufficiently high level of coupling between one of the coils of the circuit arrangement 300 and the booster antenna.

The position of the booster antenna relative to the chip package may alternatively be such that the chip package may be arranged in a corner of the booster antenna, so that turns of the booster antenna run close to and along two edges of the chip package. Configurations are also possible in which the turns of the booster antenna that run around the chip package, i.e. surround it, form a coupling coil. During manufacture, it is then possible for a chip package, for example, which may have a circuit arrangement 300 according to various embodiments, including the integrated circuit that can act as an RFID transponder, to be adhesively bonded on a support on which an associated booster antenna is arranged. This provides a simple and inexpensive way of pursuing a very flexible and modular production strategy.

The second coil 306 acts as a conventional reception coil. The reception frequency of the second coil 306 can be set by means of the first capacitance 308, which performs the function of a trimming capacitance. If need be, the contribution of a parasitic capacitance of the second coil 304 can be taken into account in this case. The second coil 306 is connected to the integrated circuit not directly but rather via the first coil 304. The first coil 304 may have a lower inductance, at any rate a lower inductance than that of the second coil 306. The first capacitance 308 is used for setting the resonant frequency of the resonant circuit including the first capacitance 308 and the second coil 306. Since, for alternating current, a capacitance becomes increasingly more conductive as the frequency of said current rises, it is possible to use this property. When high-frequency signals are received, the first capacitance 308 accordingly almost shorts them. As a result, when high-frequency signals are received by the first coil 304, the second coil is almost ineffective so to speak. The circuit arrangement 300 according to various embodiments can have its inductive coupling optimized/set for two main frequencies or two frequency ranges—for a frequency range that corresponds to the reception range of the first coil 304 and for a frequency range that corresponds to the reception range of the second coil 306.

Figure 3B:
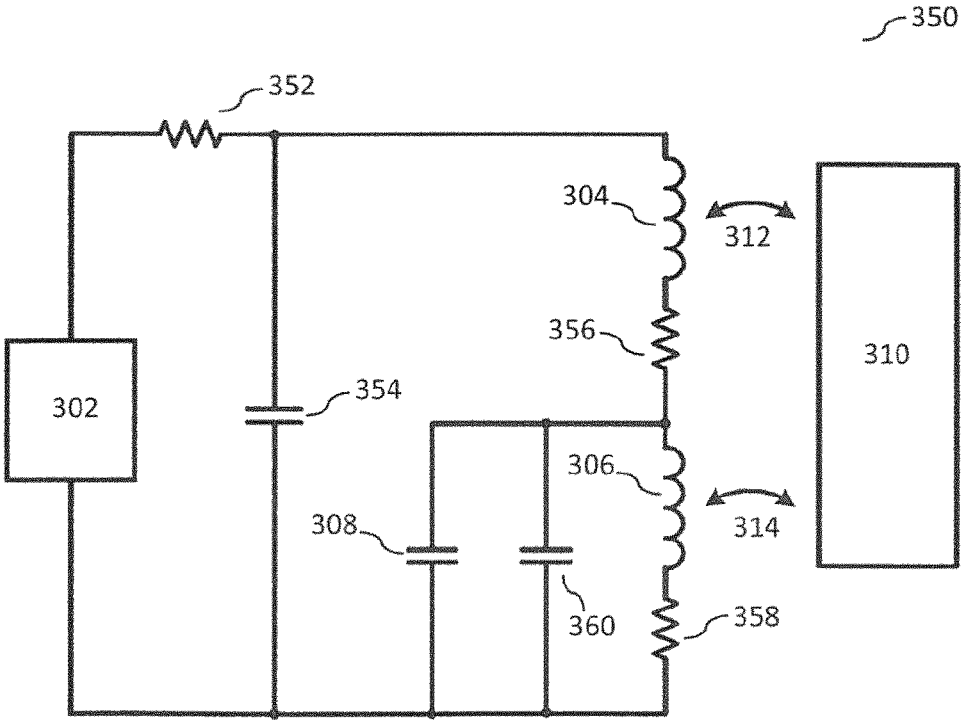

FIG. 3B shows the circuit arrangement 300 according to various embodiments from FIG. 3A with explicitly illustrated parasitic contributions from the electronic devices. Components that are the same bear the same reference symbols and are not described again. Thus, the circuit arrangement 350 according to various embodiments has a first resistor 352, which is arranged between the integrated circuit 302 and the first coil 304. The first resistor 352 represents the resistive losses from the integrated circuit 302 and the resistive losses from the associated connecting lines for the first coil 304 and for the second coil 306. A second resistor 356, which models the resistive losses in the turns of the first coil 304, is arranged between the first coil 304 and the second coil 306. A third resistor 358, which models the resistive losses in the turns of the second coil 306, is arranged between the second coil 306 and the integrated circuit 302. A second capacitance 354 is connected in parallel with the integrated circuit 302. The second capacitance 354 models the parasitic parallel capacitance of the circuit arrangement. A third capacitance 360 is connected in parallel with the serial arrangement comprising the second coil 306 and the third resistor 358. The third capacitance 360 models the parasitic capacitance that can form between the turns of the second coil 306.

When high-frequency signals are received, the electrical path via the second coil 306 is almost shorted by the first capacitance 308. The first capacitance 308 is also used to set the resonant frequency of the resonant circuit for receiving low-frequency signals. When a suitable capacitor, particularly the capacitance value thereof, is selected as the first capacitance 308, the contribution of the parasitic capacitance (i.e. of the third capacitance 360) can be taken into account. If need be, the first capacitance 308 can also be dispensed with entirely if a sufficiently large contribution is made by the parasitic capacitance. This contribution may be set by the geometry of the turns of the second coil 306 and by the choice of material therefor. The relatively low inductance of the first coil 306 in comparison with the inductance of the second coil 308 can be implemented by the capacitance of the integrated circuit 302. It is thus possible to form a resonant circuit whose resonant frequency stipulates the reception range of the first coil 304.

FIGS. 4A to 4F show various physico-spatial configurations of the circuit arrangement according to various embodiments. These exemplary configurations are just a few of very many possible component-related implementations of the circuit arrangement according to various embodiments and are not meant to be taken as restrictive, particularly in respect of the geometric shapes and the spatial arrangement of the various components.

Figure 4A:
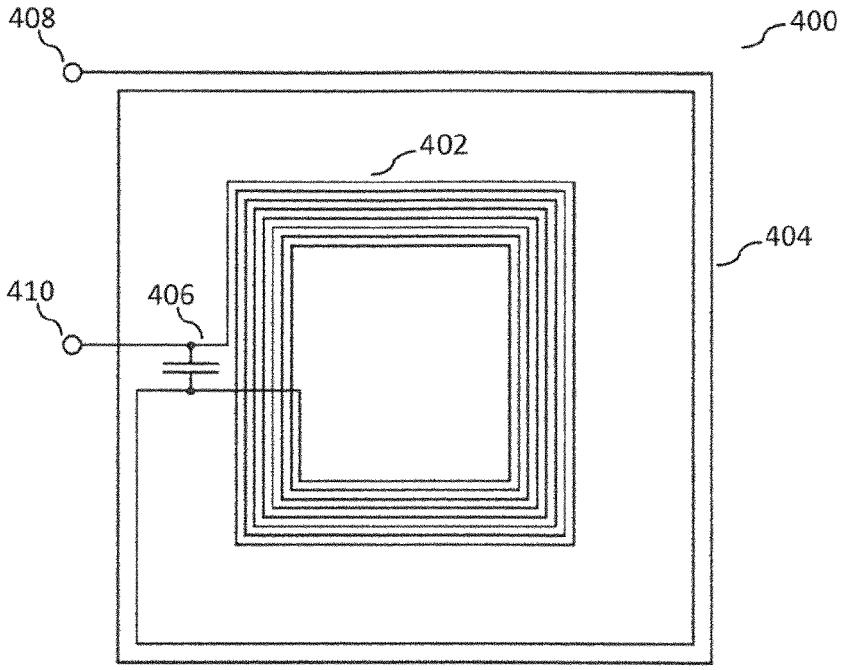
FIGS. 4A to 4F show physico-spatial configurations of the circuit arrangement according to various embodiments.

As FIG. 4A shows, the embodiment of the circuit arrangement 400 that is shown therein has the first coil 404, which is arranged on the outside and is set up to receive UHF signals. The inductance of the first coil 404 may be in the nanohenry range. The first coil 404 has the second coil 402 electrically coupled in series with it, said second coil being set up to receive HF signals, and the inductance of said second coil being able to be in the microhenry range. In this case, the second coil 402 is arranged inside the first coil 404, i.e. the turns of the first coil 404 surround the second coil 402. The second coil 402 has significantly more turns than the first coil 404, since firstly it takes up a smaller surface area and secondly it has a higher inductance than the first coil 404. In addition, the circuit arrangement 400 according to various embodiments has a capacitance 406 that is coupled in parallel with the second coil 402. One end of the first coil 404 is provided with a first connection 408, and the other end of the first coil 404 is electrically coupled to the second coil 402, with a second connection 410 in turn being provided at the other end of the second coil 402. By way of example, the first connection 408 and the second connection 410 can be used to couple the circuit arrangement 400 to an integrated circuit, for example an RFID chip, as shown in FIG. 3A and FIG. 3B, for example. In between, however, there may naturally also be further components electrically coupled, such as capacitances, coils or resistors.

In various embodiments of the circuit arrangement 400, the first coil 404 may be arranged in the inner region of the second coil 402. In other words, the spatial arrangement of the two coils with respect to one another, as shown in FIG. 4A, can be transposed. The required inductances can then be set by means of the geometric configuration of the respective coils.

Figure 4B:
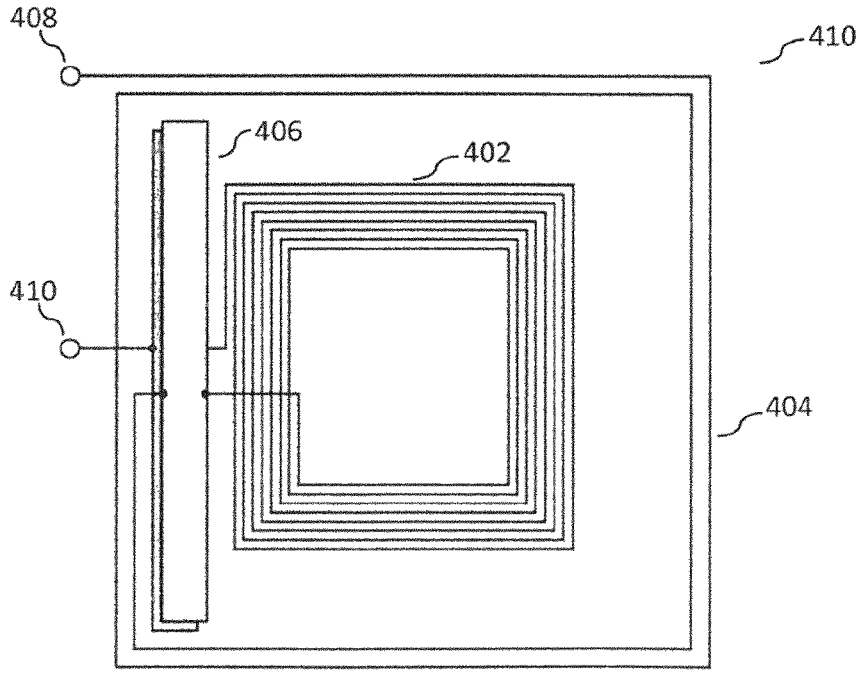

FIG. 4B shows a further embodiment of the circuit arrangement 410. The circuit arrangement 410 shown therein is essentially similar to the circuit arrangement 400 shown in FIG. 4A, which means that components that are the same have been provided with the same reference symbols (which otherwise also applies to the various embodiments of the circuit arrangement according to various examples in FIG. 4C to FIG. 4F). The main difference is that in FIG. 4B the capacitance 406 is shown as a component-related configuration. In this case, the capacitance 406 has two rectangular plates that have a conductive material. The two capacitor plates are electrically insulated from one another by means of a dielectric layer. The two capacitor plates of the capacitance 406 may be arranged on a surface of a support on which the whole circuit arrangement 410 according to various embodiments may be arranged. The two capacitor plates of the capacitance 406 may also be arranged on different sides of the support, however, with the support layer then being able to be used as a dielectric. Appropriate conductive bushings through the support layer can be used to electrically couple the circuit components on both sides of the support to one another.

Figure 4C:
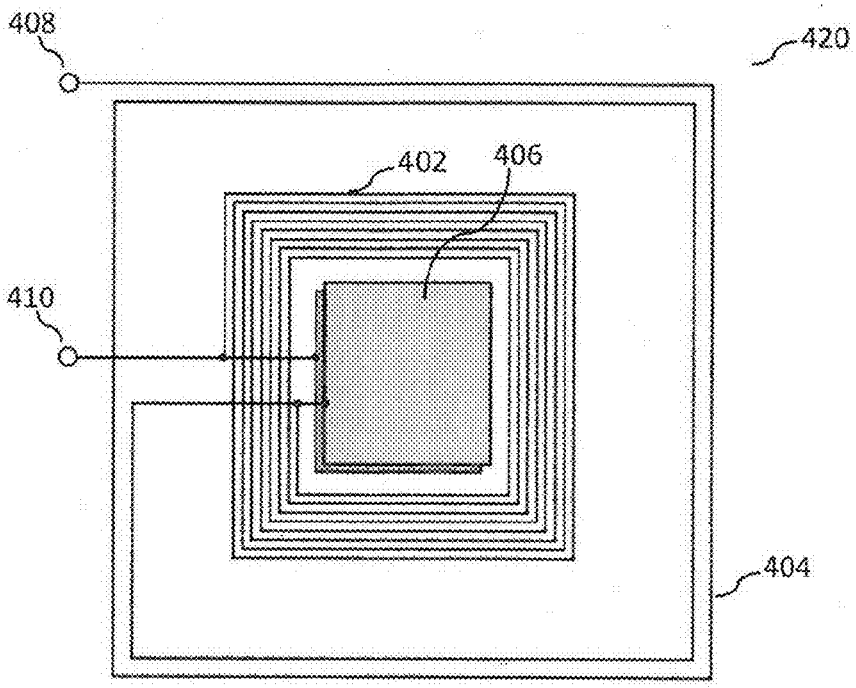

In general, the capacitance 406 can be implemented in many different ways. The position and geometric shape thereof may also be arbitrary and can essentially be matched to the relevant application. The rectangular capacitor plates shown in FIG. 4B can also be configured in an L-shape or U-shape, for example, depending on the desired capacitance and the materials used. Thus, the two capacitor plates of the capacitance 406 are of square configuration in the case of the further circuit arrangement 420 according to various embodiments that is shown in FIG. 4C, and is arranged in the inner region of the second coil 402. Otherwise, the circuit arrangement 420 shown in FIG. 4C corresponds to the circuit arrangements shown previously in FIG. 4A and FIG. 4B.

In various embodiments of the circuit arrangement, the capacitance 406 may be integrated in a chip package together with the whole circuit arrangement 410 according to various embodiments. The capacitance 406 may be present in the form of an MIMCAP (metal-insulator-metal capacitance), an MOMCAP (metal-oxide-metal capacitance) or, by way of example, an MOSCAP (metal-oxide-semiconductor capacitance). In this case, the three materials cited correspond to the order of the materials used for providing the capacitance.

Figure 4D:
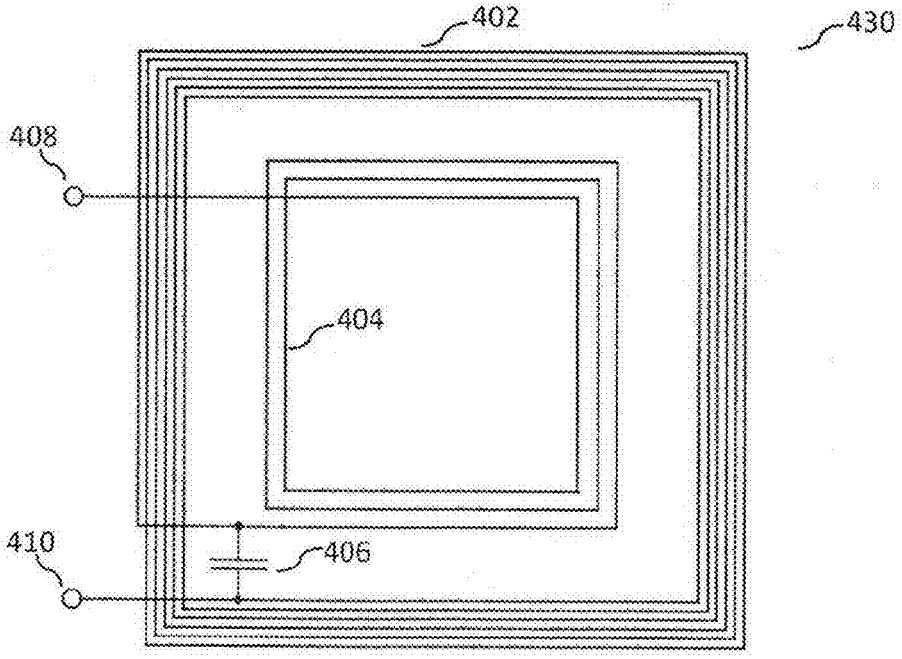

In the embodiment of the circuit arrangement 430 that is shown in FIG. 4D, the position of the two antennas is transposed in comparison with the previous embodiments, i.e. the turns of the second coil 402 enclose the turns of the first coil 404. The capacitance 406 continues to be connected in parallel with the second coil 402.

Figure 4E:
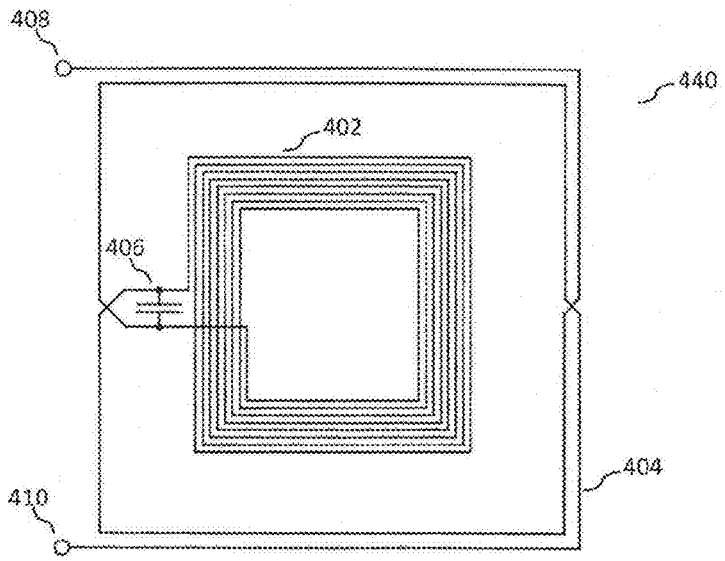

FIG. 4E shows a further embodiment of the circuit arrangement 440. In this embodiment, the first coil 404 acts as a symmetric electrical supply line for the second coil 402. In this embodiment, the first connection 408 terminates one end of the first coil 404 and the second connection 410 terminates the other end of the first coil 404. The second coil 402 is provided symmetrically, in terms of components, within the first coil 404.

Figure 4F:
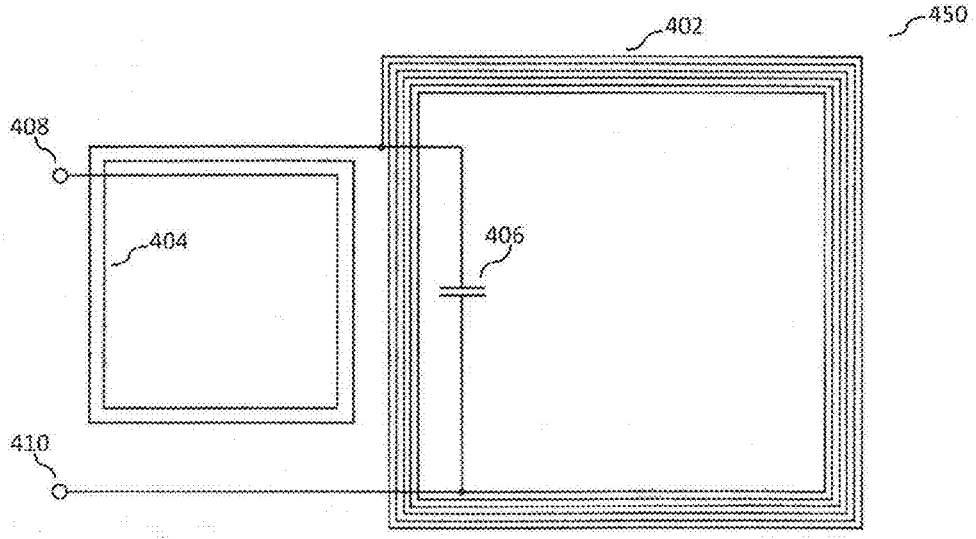

In the embodiment of the circuit arrangement 450 that is shown in FIG. 4F, the first coil 404 is arranged outside the region in which the second coil 402 is arranged. In other words, no coil encloses the other in this case, but rather said coils are arranged next to one another. By way of example, this embodiment can be used when there is sufficient space on the support for implementing the components of the circuit arrangement. By contrast, the other embodiments of the circuit arrangement that are shown in FIG. 4A to FIG. 4E show rather compact circuit arrangements according to various embodiments, in which one coil is arranged around the other.

Figure 5:
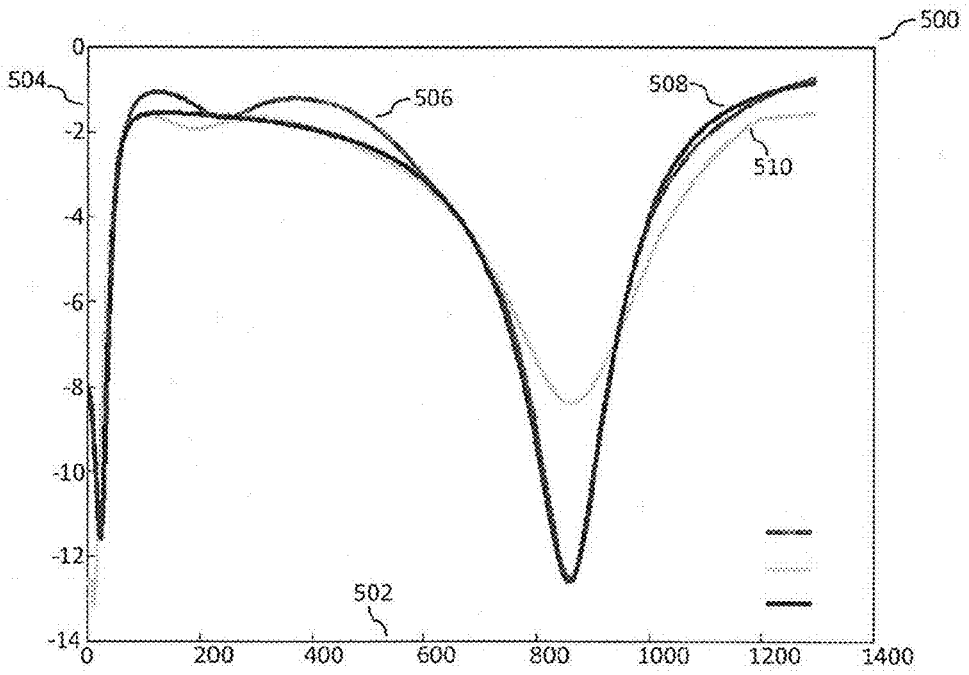
FIG. 5 shows a graph that shows the reflection parameter of the circuit arrangement according to various embodiments.

FIG. 5 shows a graph 500 that shows the input reflection factor S11 for various scenarios. When seen in general terms, the input reflection factor S11 describes that proportion of the power in decibels that is reflected at the input connection of the antenna. The smaller (toward negative values) the input reflection factor S11, the more power can be coupled into the antenna and radiated thereby at one frequency.

The graph 500 plots the frequency in megahertz on the x axis 502 and plots the measure of the proportion of the reflected power, or the power accepted by the circuit arrangement according to various embodiments, in decibels, on the y axis 504. A first curve 506 shows the frequency-dependent reflection parameter S11 that has been calculated by simulation on the basis of the circuit arrangement according to various examples. A second curve 508 shows the frequency-dependent reflection parameter S11 that has been calculated by simulation on the basis of an equivalent circuit diagram for the circuit arrangement according to various examples. Finally, a third curve 510 shows the frequency-dependent reflection parameter S11 that has been ascertained by surveying (for example using a network analyzer) the circuit arrangement according to various examples.

All three curves show two resonant structures, in this exemplary case at approximately 13.56 MHz and at approximately 868 MHz. That is to say that at approximately 13.56 MHz and at approximately 868 MHz an overwhelming large portion of the power fed into the antenna is consumed, i.e. radiated by the antenna. In the case of these frequency bands, the circuit arrangement according to various embodiments is also capable of optimally receiving corresponding signals. From the curves, it is also possible to ascertain the bandwidth, which may be provided by the −6 dB value, for example. Accordingly, the resonance at 13.56 is a very narrowband resonance, while the resonance at 868 MHz has a bandwidth of approximately 200 MHz as a result of the definition provided. Although the proportion of the power picked up by the antenna differs from the real case (third curve 510) in the simulated case (first curve 506), the graph shown in FIG. 5 makes it clear that the circuit arrangement according to various embodiments can be operated at two main frequencies or in two frequency bands, which can also be set according to the requirements imposed by the use environment of the circuit arrangement.

The circuit arrangement according to various embodiments is an extended antenna structure that is capable of receiving and sending electromagnetic waves in the HF band and in the UHF band. The circuit arrangement according to various embodiments may have a first antenna, which is set up to couple to an electromagnetic field from a first frequency band, and a second antenna, which is set up to couple to an electromagnetic field from a second frequency band, the second frequency band being different than the first frequency band. In this case, the first antenna may be connected in series with the second antenna as a supply line therefor. The antenna structure described here can be tuned to multiple frequency ranges. By way of example, the first antenna may be tuned to a frequency or a frequency band from the UHF band, for example to 868 MHz or to another frequency that corresponds to an operating frequency according to the RFID standard (RFID: radio-frequency identification—identification by means of electromagnetic waves) from the UHF band. The second antenna may be tuned to a frequency or a frequency band from the HF band, for example to 13.56 MHz or to another frequency that corresponds to an operating frequency according to the RFID standard (RFID: radio-frequency identification—identification by means of electromagnetic waves) from the HF band. The very compact and miniaturized form, as described below, of the circuit arrangement according to various embodiments and the multifrequency band function thereof mean that said circuit arrangement may also be arranged on a chip package of a chip card module as an integrated antenna structure together with a chip, for example.

According to various embodiments of the circuit arrangement, the first antenna may have a coil.

According to various embodiments of the circuit arrangement, the second antenna may have a coil.

The first antenna and the second antenna may be in the form of loop antennas, for example. The arrangement of the conductor tracks of the first coil and/or of the second coil may describe a square or rectangular shape, for example, and be matched to the available space in the use environment of the circuit arrangement.

According to various embodiments of the circuit arrangement, the first coil may be entirely connected upstream or connected downstream of the second coil. In other words, one end of the conductor track that forms turns of the first coil may be electrically coupled to one end of the conductor track that forms turns of the second coil.

According to various embodiments of the circuit arrangement, the second coil may be connected between two portions of the first coil. In other words, each of the two ends of the conductor track that forms turns of the second coil may be electrically coupled to a respective portion of the first coil. Expressed in yet another way, the second coil may be formed within the first coil, so that a current flowing through the serial arrangement including the first coil and the second coil flows through first one portion of the first coil, then the whole second coil and then a various portion of the first coil.

According to various embodiments of the circuit arrangement, the two portions of the first coil may be in the form of symmetric electrical supply lines for the first coil. The symmetry may relate to the length of the conductor tracks that form the first coil, these accordingly being able to be of the same length, or else additionally to the spatial arrangement of said conductor tracks, so that, by way of example, one portion of the first coil can be converted into the other portion of the first coil by a symmetry operation, for example rotation or point mirroring.

According to various embodiments of the circuit arrangement, the inductance of the first antenna may be lower than the inductance of the second antenna.

According to various embodiments, the circuit arrangement may also have a first capacitance, which is connected in parallel with the second antenna.

According to various embodiments of the circuit arrangement, the first capacitance may be implemented by means of a parasitic capacitance of the first antenna. The parasitic capacitance of the first antenna can form between two respective sections of conductor tracks of the first antenna that run next to one another, and, where necessary, can be set to a required or desired value by various parameters such as conductor track thickness, distance of the conductor tracks from one another and geometry of the antenna.

According to various embodiments, the circuit arrangement may also have an integrated circuit that is electrically coupled to the serial arrangement comprising the first antenna and the second antenna. The integrated circuit may be a chip that (together with the whole circuit arrangement) is arranged in a chip package of a chip card module. By way of example, the chip may be set up as a transponder and can be read wirelessly by a reading unit using the first antenna and the second antenna. When necessary, the chip card module of a chip card may also have a contact array if the chip card is a dual interface chip card.

According to various embodiments, the circuit arrangement may have a second capacitance, which may be connected in parallel with the integrated circuit.

According to various embodiments of the circuit arrangement, the second capacitance may be implemented by means of a capacitance of the integrated circuit.

According to various embodiments of the circuit arrangement, the first antenna may be set up to receive electromagnetic waves from the UHF band.

According to various embodiments of the circuit arrangement, the second antenna may be set up to receive electromagnetic waves from the HF band.

In various embodiments, a chip card is provided that may have the circuit arrangement according to various embodiments. The circuit arrangement, which has the two antennas, can be used to lend the corresponding chip card a multifrequency band function, i.e. said chip card can be read by means of electromagnetic waves using two different frequencies or frequency bands.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement, comprising:

a first coil antenna tuned to a first resonant frequency, configured to inductively couple to an electromagnetic field from a radio frequency identification reading apparatus, the electromagnetic field being within a first frequency band, and the first coil antenna connected in series to a second coil antenna as an electrical supply line therefore;

the second coil antenna tuned to a second resonant frequency and configured to inductively couple to an electromagnetic field from the radio frequency identification reading apparatus, the electromagnetic field being within a second frequency band, the second resonant frequency being different from the first resonant frequency, and the second frequency band being different than the first frequency band; and a first capacitance, connected in parallel with the second coil antenna, wherein the first capacitance is configured to be implemented by a parasitic capacitance of the first coil antenna and is further configured to set the second resonant frequency;

wherein the first capacitance shortens the electrical path to the second antenna when a signal corresponding to the first frequency band is received by the first antenna; and wherein the second coil receives the second frequency irrespective of the first coil antenna due to a difference between the first resonant frequency and the second resonant frequency.

2. The circuit arrangement of claim 1, wherein the first coil is entirely connected upstream or connected downstream of the second coil.

3. The circuit arrangement of claim 1, wherein the second coil is connected between first portions and second portions of the first coil.

4. The circuit arrangement of claim 3, wherein the second portions of the first coil are in the form of symmetric electrical supply lines for the first coil.

5. The circuit arrangement of claim 1, wherein the inductance of the first antenna is lower than the inductance of the second antenna.

6. The circuit arrangement of claim 1, further comprising:

an integrated circuit that is coupled to the serial arrangement comprising the first antenna and the second antenna.

7. The circuit arrangement of claim 6, further comprising:

a second capacitance, which is connected in parallel with the integrated circuit.

8. The circuit arrangement of claim 7, wherein the second capacitance is implemented by a capacitance of the integrated circuit.

9. The circuit arrangement of claim 1, wherein the first antenna is configured to receive electromagnetic waves from the UHF band.

10. The circuit arrangement of claim 1, wherein the second antenna is set up to receive electromagnetic waves from the HF band.

11. A chip card, comprising:

a circuit arrangement, comprising:

a first coil antenna tuned to a first resonant frequency, configured to inductively couple to an electromagnetic field from a radio frequency identification reading apparatus, the electromagnetic field being within a first frequency band, and the first coil antenna connected in series to a second coil antenna as an electrical supply line therefore;

the second coil antenna tuned to a second resonant frequency and configured to inductively couple to an electromagnetic field from the radio frequency identification reading apparatus, the electromagnetic field being within a second frequency band, the second resonant frequency being different from the first resonant frequency, and the second frequency band being different than the first frequency band; and a first capacitance, connected in parallel with the second coil antenna, wherein the first capacitance is configured to be implemented by a parasitic capacitance of the first coil antenna and is further configured to set the second resonant frequency;

wherein the first capacitance shortens the electrical path to the second antenna when a signal corresponding to the first frequency band is received by the first antenna; and wherein the second coil receives the second frequency irrespective of the first coil antenna due to a difference between the first resonant frequency and the second resonant frequency.

12. The circuit of claim 11, further comprising a first resistor, said first resistor being arranged between the integrated circuit and the first coil.

13. The circuit of claim 11, further comprising a second capacitance, which is connected in parallel with the integrated circuit, wherein the second capacitance is implemented by a capacitance of the integrated circuit.

14. The circuit of claim 11, further comprising a second resistor, being arranged between the first coil and the second coil.

15. The circuit of claim 11, further comprising a third capacitance, which is connected in parallel with a serial arrangement comprising the second coil and the third resistor.

* * * * *